US005507235A

United States Patent [19]

Dugge et al.

[11] Patent Number: 5,507,235

[45] Date of Patent: Apr. 16, 1996

[54] GRAVITY OUTLET

[75] Inventors: Richard H. Dugge, Des Peres, Mo.; Gregory E. Bertram, Valmeyer, Ill.

[73] Assignee: ACF Industries Incorporated, Earth City, Mo.

[21] Appl. No.: 186,377

[22] Filed: Jan. 25, 1994

[51] Int. Cl.[6] ..... B61D 7/00

[52] U.S. Cl. ..... 105/282.3; 105/308.2; 105/310

[58] Field of Search ..... 105/282.1, 282.2, 105/282.3, 294, 305, 310, 308.1, 311.2, 313; 222/561, 153

[56] References Cited

U.S. PATENT DOCUMENTS

| | | | |
|---|---|---|---|
| 2,646,006 | 7/1953 | Dorey | 105/282.2 |
| 2,646,007 | 7/1953 | Dorey | 105/282.2 |
| 3,683,820 | 8/1972 | Floehr | 105/282.1 |
| 3,877,392 | 4/1975 | Askester et al. | 105/282 |
| 4,214,536 | 7/1980 | Waddell et al. | 105/282 |
| 4,248,158 | 2/1981 | Chierici et al. | 105/282.1 |
| 4,342,267 | 8/1982 | Blout | 105/282.2 |
| 4,528,913 | 7/1985 | Randolph | 105/282 |
| 4,599,948 | 7/1986 | Randolph | 105/282 |
| 5,272,987 | 12/1993 | Lucas | 105/282.3 |
| 5,353,713 | 10/1994 | Dohr et al. | 105/310 |

OTHER PUBLICATIONS

Association of American Railroads Mechanical Division, Manual of Standards and Recommended Practices 91/92 (relevant portions) (pp. C–12—C–13.4 and 2–8).

*Primary Examiner*—Mark T. Le

*Attorney, Agent, or Firm*—Polster, Lieder, Woodruff & Lucchesi

[57] ABSTRACT

A gravity outlet (10) for discharging lading from a railway car (C). An outlet assembly is attached to a discharge opening in the railcar. The assembly includes an upper end attached to the discharge opening, and sidewalls (**14*a*, 14*b*) and endwalls (16*a*, 16*b*) sloping downwardly and inwardly from the upper end. A bottom portion of the sidewalls and endwalls define a discharge outlet (D) through which lading flows, by gravity, when it is discharged from the railcar. An outlet gate (22) is positioned beneath the assembly and is movable relative to the discharge outlet between respective open and closed positions to open and close the outlet. A latch assembly (26) latches the outlet gate in its closed position, when the gate is closed, to prevent inadvertent opening of the gate and spillage of lading. A gate operating mechanism (34**) moves the gate between its open and closed positions. The mechanism automatically unlatches the latch when the gate is to be moved from its closed to its open position. The mechanism unlatches the latch prior to moving the gate. And, the gate operating mechanism automatically relatches the latch when it moves the gate from its open to its closed position.

10 Claims, 13 Drawing Sheets

GRAVITY OUTLET

BACKGROUND OF THE INVENTION

This invention relates to outlets used to discharge lading from covered hopper railway cars, and, more particularly, to a gravity outlet which meets current American Association of Railways (AAR) regulations.

As is well-known, gravity outlets have been used on covered hopper railway cars for discharging ladings such as grains from the cars. See, for example, U.S. Pat. Nos. 4,599,948, 4,528,913, 4,214,536, 3,877,392, and 3,779,172, and United States patent application 08/052,135, all of which are assigned to the same assignee as the present invention, together with U.S. Pat. Nos. 4,534,298, 4,301,741, 3,938,861, 3,415,204, and 3,138,117. With respect to gravity outlets, there are a number of problem areas which exist. Among these are current outlet designs with which there is the possibility of contamination of one lading with another, adequate sealing of the outlet to prevent dirt, dust, debris, and moisture from migrating into the outlet and contaminating or spoiling the lading, the ease of use of current gate operating mechanisms, and the force required to open an outlet gate at the start of an off-loading operation.

With respect to the first of these concerns, current gravity outlets have standard size discharge openings; 13"×42" (33.0 cm.×106.7 cm.) being an exemplary standard size opening. However, it is not uncommon that within the outlet there are rectangularly shaped sections whose measurements differ from these. There may, for example be a segment whose length and/or width is slightly larger or smaller than the above. As a result, a shelf is created at the interface between the two outlet segments where lading can collect. If the outlet is not properly cleaned between ladings, particles of the previous lading will remain on the shelf and can contaminate a subsequent lading. Besides contamination, the particles may also cause spoilage of the subsequent lading. And, if the lading builds up and hardens on the outlet gate, it can prevent the outlet from properly closing. The outlet, because it is on the underside of the car, is exposed to all sorts of possible contaminants as the car moves from one location to another. Dirt, dust, collected moisture, and other kinds of debris are all thrown up around the outlet. Rainwater flowing down the sides of the car or sprayed up off the roadbed also can strike the outlet. Adequate sealing is required to prevent these contaminants from getting into the outlet and damaging the lading. In a different regard, when the outlet gate for the outlet is closed, lading sits atop the gate. When the gate is opened, it is withdrawn from the outlet. It is possible that the gate will carry particles of the lading away as it is moved. Not only does means that a small portion of the lading may be retained within the car, but also that this is yet anothere source of contamination and spoilage.

Typically, the outlet gate for a gravity oulet has a locking mechanism by which the gate is locked in its closed position so as to not inadvertently open during transit. When it is time to unload the car, opening the gate has heretofore been a two step operation. The first step is in unlocking the gate; the second, actually opening thegate. Because each covered hopper railway car has a number of hoppers in each unit, each hopper having its associated outlet, and a train typically includes many cars, the task of unlocking and then opening each separate outlet as each car is unloaded becomes a very time consuming task. Especially, when each gate has to be closed and then relocked after the hopper is empty. In addition, considerable amounts of torque often have to be applied to open a gate because of the "footprint" i.e. surface area of the gate upon which lading sits.

Recently, the AAR and grain elevator operators have addressed these various issues. One result has been promulgation by the AAR of new regulations concerning gravity outlet design and operation. This is AAR standard S-233. Among the requirements of this new standard are section 2.5 which requires the bottom outlet area of hoppers be designed, installed, and maintained to prevent entrance of water, waste, and debris during transit. Section 2.6 requires that the opening mechanism have a stipulated maximum breakaway torque under defined test conditions. For the 13"×42" outlet mentioned above, the torque value is 700 ft.-lbs. Section 2.7 requires that for grain service there be a clear opening (no ledges, etc.) of the discharge gates. Section 2.8 stipulates that the locking mechanism be accessible from both sides of the railcar, and section 2.9 this mechanism be integrated with the gate operating mechanism. Finally, for purposes of this discussion, section 2.10 requires the gate mechanism to have an automatic locking mechanism.

SUMMARY OF THE INVENTION

Among the several objects of the present invention may be noted the provision of a gravity outlet for use on covered hopper railway cars; the provision of such an outlet to have a gate movable relative to the outlet to open and close the outlet, a mechanism for so moving the gate, and a latch mechanism for locking the gate in its closed position; the provision of such an arrangement in which the operation of the gate operating mechanism and latching mechanism are integrated so that movement of the gate operating mechanism automatically unlatches the gate when the mechanism is operated to open the gate, and automatically latches the gate in a locked position when the mechanism is operated to close the gate; the provision of such a mechanism to employ a lost motion arrangement by which unlocking and opening of the gate and closing and relocking of the gate are accomplished in a proper sequence utilizing but a single, simple mechanism; the provision of such an outlet having a discharge area which is open throughout and provides no area in which lading will collect so as to contaminate a subsequent lading; the provision of such an outlet wherein the lower edges of slope sheets defining sidewalls and endwalls of the outlet create a minimum outlet area to minimize the lading footprint on the gate to reduce the torque required to open the gate; the provision of such an outlet to employ a sealing arrangement which prevents dirt, dust, debris, rain, etc. from getting into the outlet and contaminating a lading; the provision of such an outlet in which the torque required to effect opening of the gate is generally constant under various loading conditions; the provision of such an outlet to meet AAR standards concerning gravity outlet designs; and, the provision of such an outlet which is readily cleaned after usage, and can be used both as original equipment on a railcar or as a retrofit outlet.

In accordance with the invention, generally stated, a gravity outlet is for discharging lading from a railway car. An outlet assembly is attached to a discharge opening in the railcar. The assembly includes an upper end attached to the discharge opening, and sidewalls and endwalls sloping downwardly and inwardly from the upper end. A bottom portion of the sidewalls and endwalls define a discharge outlet through which lading flows, by gravity, when it is discharged from the railcar. An outlet gate is positioned beneath the assembly and is movable relative to the discharge outlet between respective open and closed positions to open and close the outlet. A latch latches the outlet gate in its closed position, when the gate is closed, to prevent inadvertent opening of the gate and spillage of lading. A gate operating mechanism moves the gate between its open and closed positions. The mechanism automatically unlatches the latch when the gate is to be moved from its closed to its open position. The mechanism unlatches the latch prior to moving the gate. And, the gate operating mechanism automatically relatches the latch when it moves the gate from its open to its closed position. Other objects and features will be in part apparent and in part pointed out hereinafter.

BRIEF DESCRIPTION OF THE DRAWINGS

FIGS. 9A and 9B are partial elevational views of the outlet illustrating operation of a gate opening mechanism to automatically unlatch and relatch an outlet gate of the outlet wherein FIG. 9A represents the latched position of the gate and FIG. 9B the unlatched position;

Corresponding reference characters indicate corresponding parts throughout the drawings.

DESCRIPTION OF A PREFERRED EMBODIMENT

Figure 1:
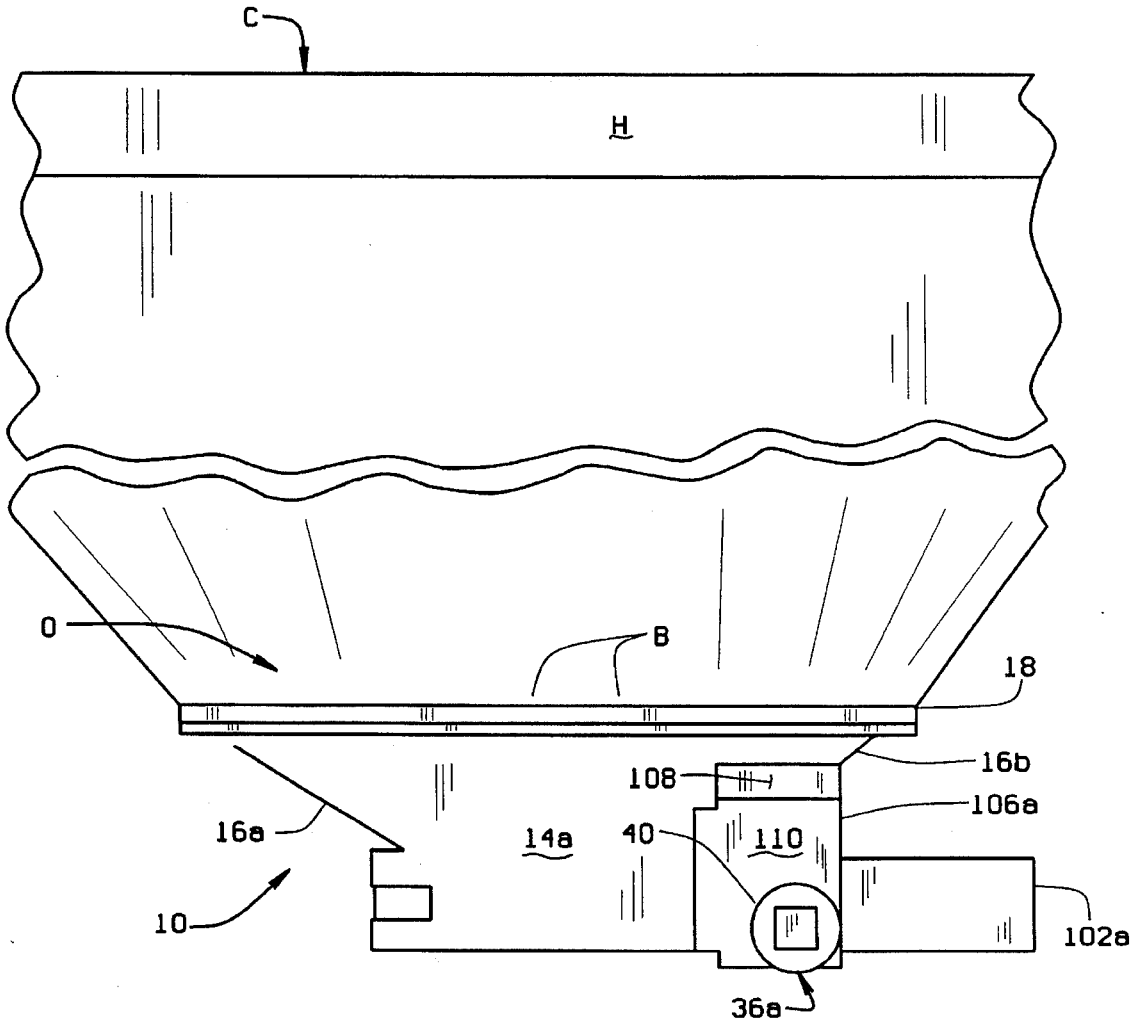
FIG. 1 is a partial elevational view of a railcar with a gravity outlet of the present invention installed.

Referring to the drawings, a railway car C is for transporting a lading such as a grain. The railcar may be a covered hopper railcar of the type well-known in the art. A gravity outlet 10 of the present invention is installed at a lower outlet O of a hopper H of the railcar. When it is open, the gravity outlet allows the grain to discharge through the outlet so to be offloaded from the railcar. It will be understood that while particularly suitable for use on railcars, the outlet may be used on over-the-road trucks, storage bins, or other suitable containers.

Figure 2:
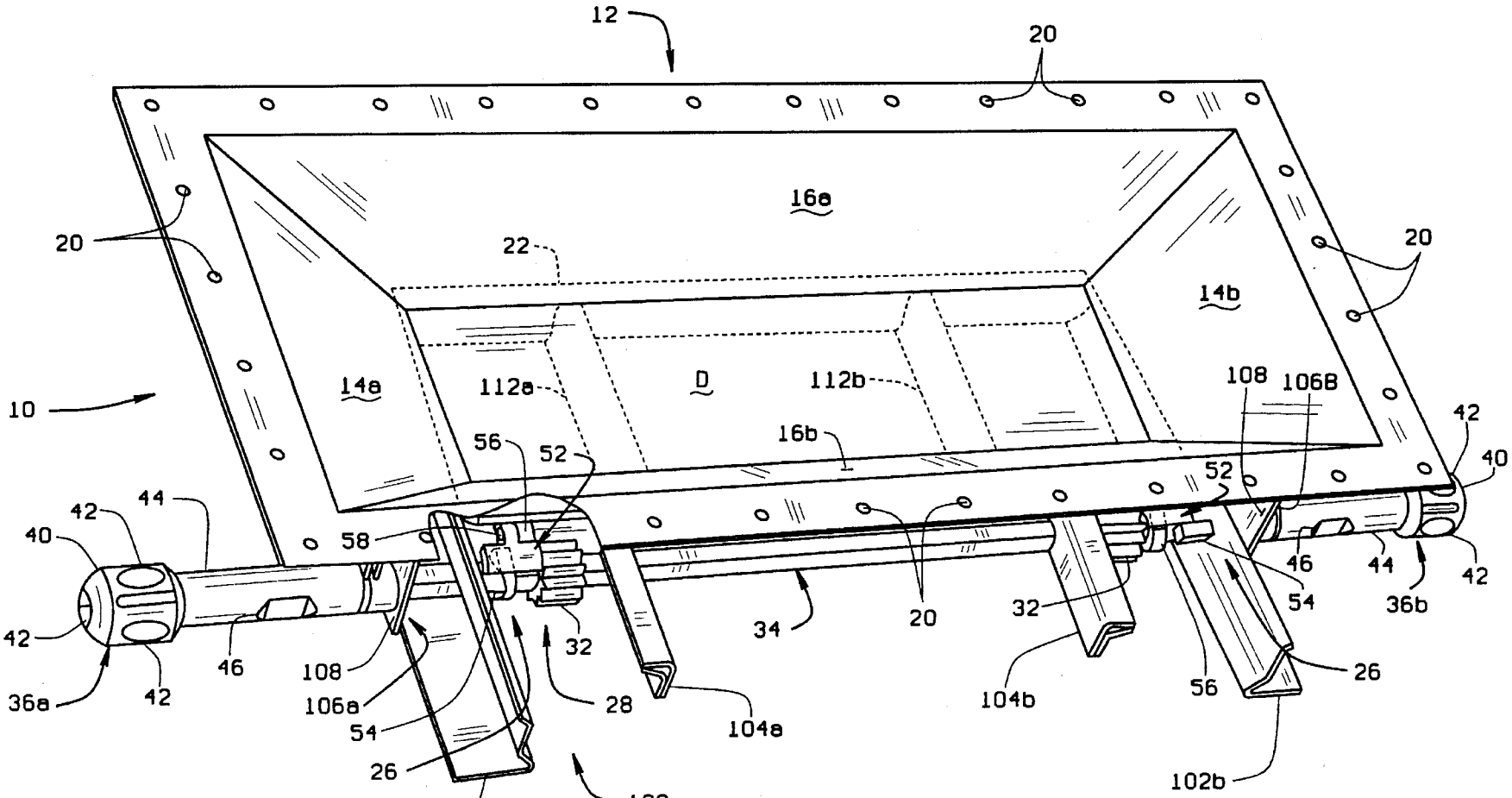
FIG. 2 is a perspective view of the gravity outlet.
Figure 3:
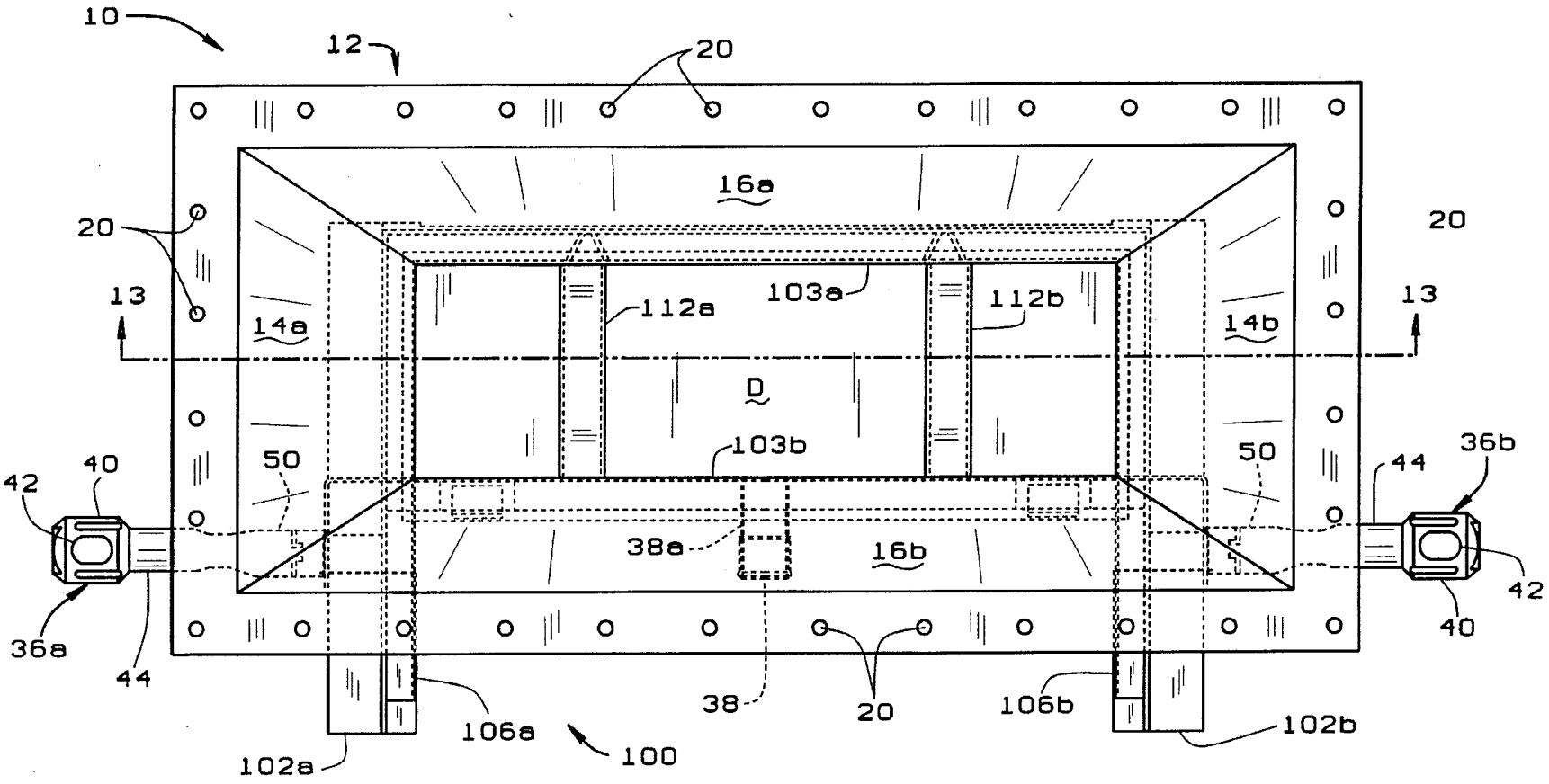
FIG. 3 is a top plan view of the outlet.
Figure 4:
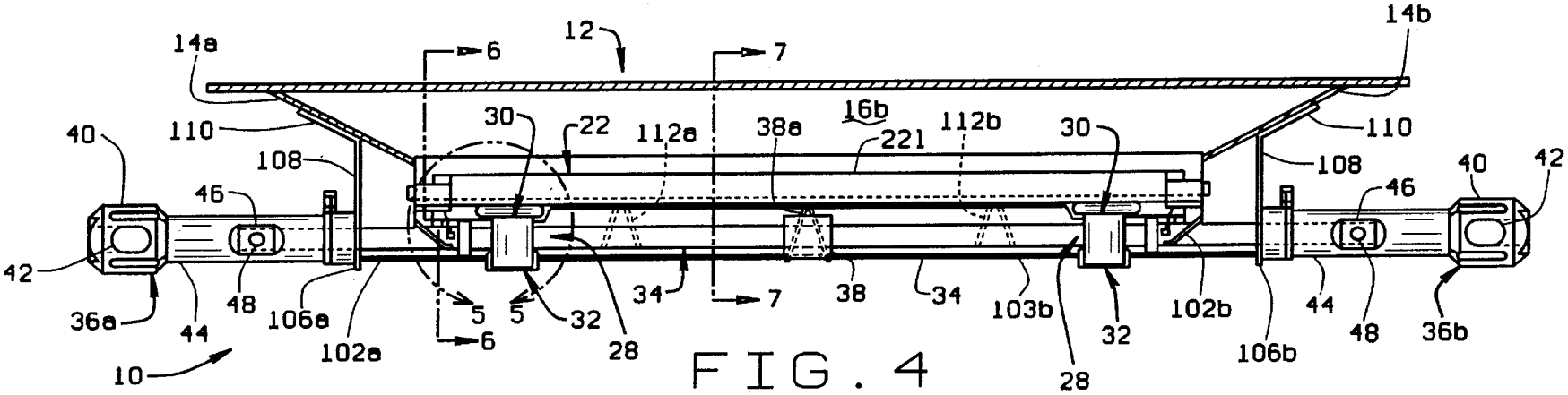
FIG. 4 is an end elevational view of the outlet.
Figure 5:
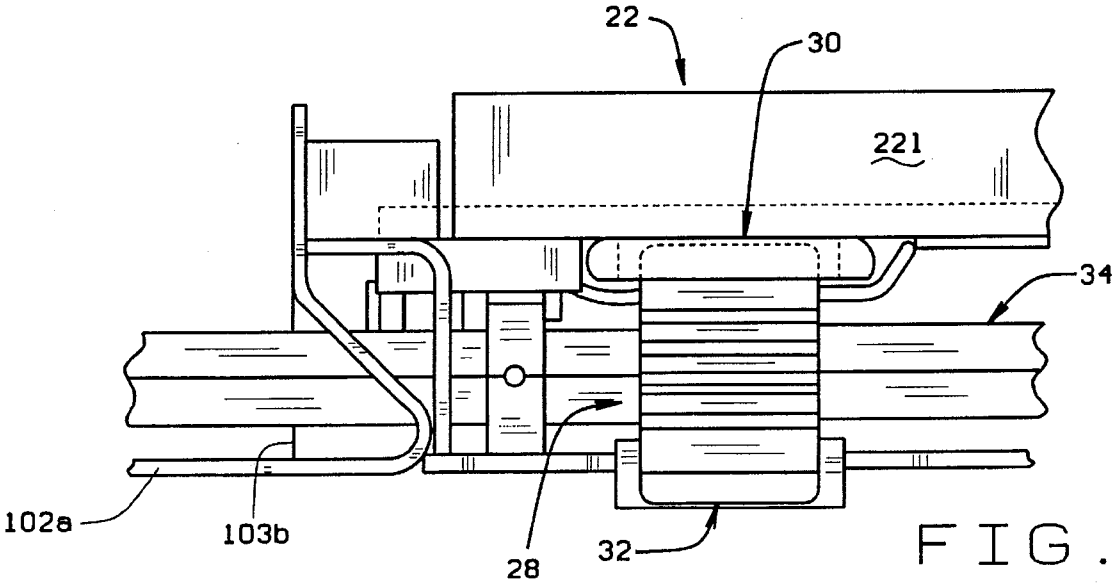
FIG. 5 is a partial end elevational view taken along line 5—5 in FIG. 4.

Gravity outlet 10 first includes means 12 defining an outlet assembly which is attached to discharge opening O of the railcar. Referring to FIGS. 2–4, means 12 includes respective opposed sidewalls 14*a*, 14*b*, and opposed endwalls 16*a*, 16*b*. These sections are generally trapezoidal when viewed in plan (see FIG. 3). The sidewalls extend lengthwise of the railcar, and the endwalls transversely thereof. Each sidewall and endwall is formed of a respective slope sheets each of which has an outwardly turned, horizontally extending flange formed at its upper end. These flanges mate with respective portions of a flange 18 to mount outlet 10 to outlet O. The flanges have a plurality of spaced bolt holes 20 for attaching the outlet to flange 18 with bolts B. Each sidewall and endwall has a sloping wall which slopes downwardly and inwardly from the upper end of the outlet. The bottom portion of the sidewalls and endwalls define a discharge outlet D through which the lading, grain, for example, flows by gravity, when it is discharged from the railcar.

The sidewalls and endwalls are supported by a support structure 100 which includes longitudinally extending boot flanges 102*a*, 102*b* that respectively extend beneath sidewalls 14*a*, 14*b*. Similar flanges 103*a*, 103*b* extend beneath the respective endwalls 16*a*, 16*b*. In addition, inverted L-shaped gate support members 104*a*, 104*b* extend rearwardly from endwall 16*b* on either side of the longitudinal centerline of the gravity outlet (see FIG. 14). Also extending longitudinally of the sidewalls are respective side plates 106*a*, 106*b*. The plates each have a vertically depending lower section 108 and an upper section 110 which is angled to abut against the outer face of the sidewalls.

Figure 9A:
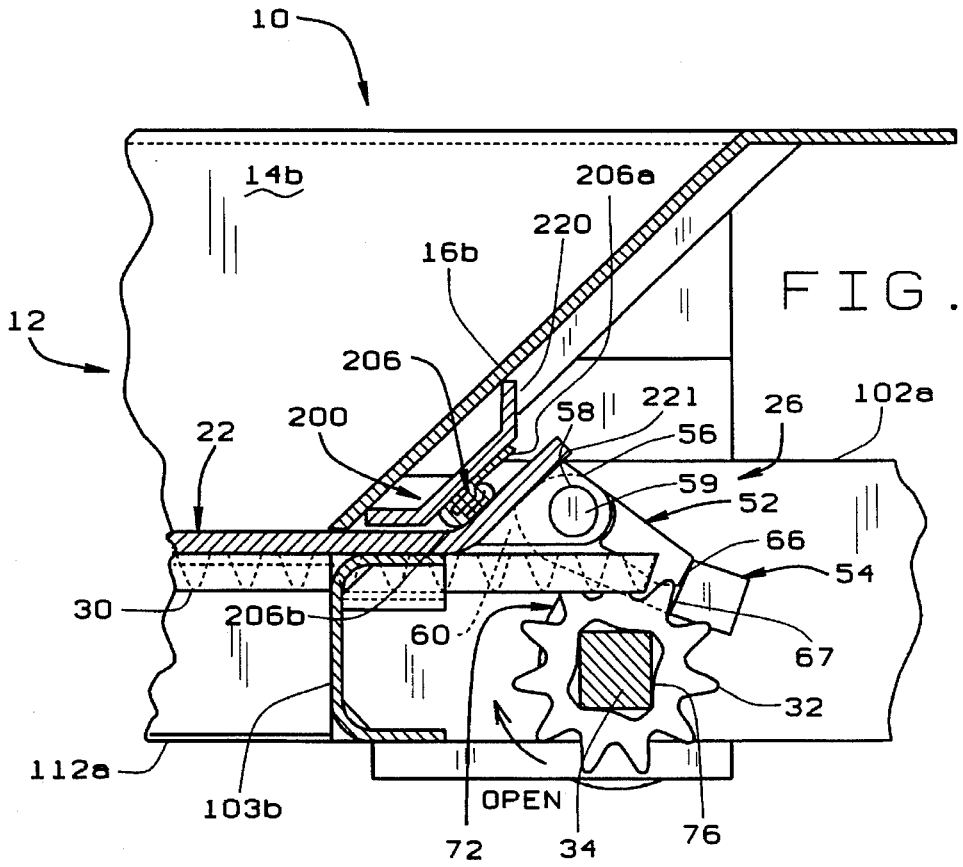
Figure 9B:
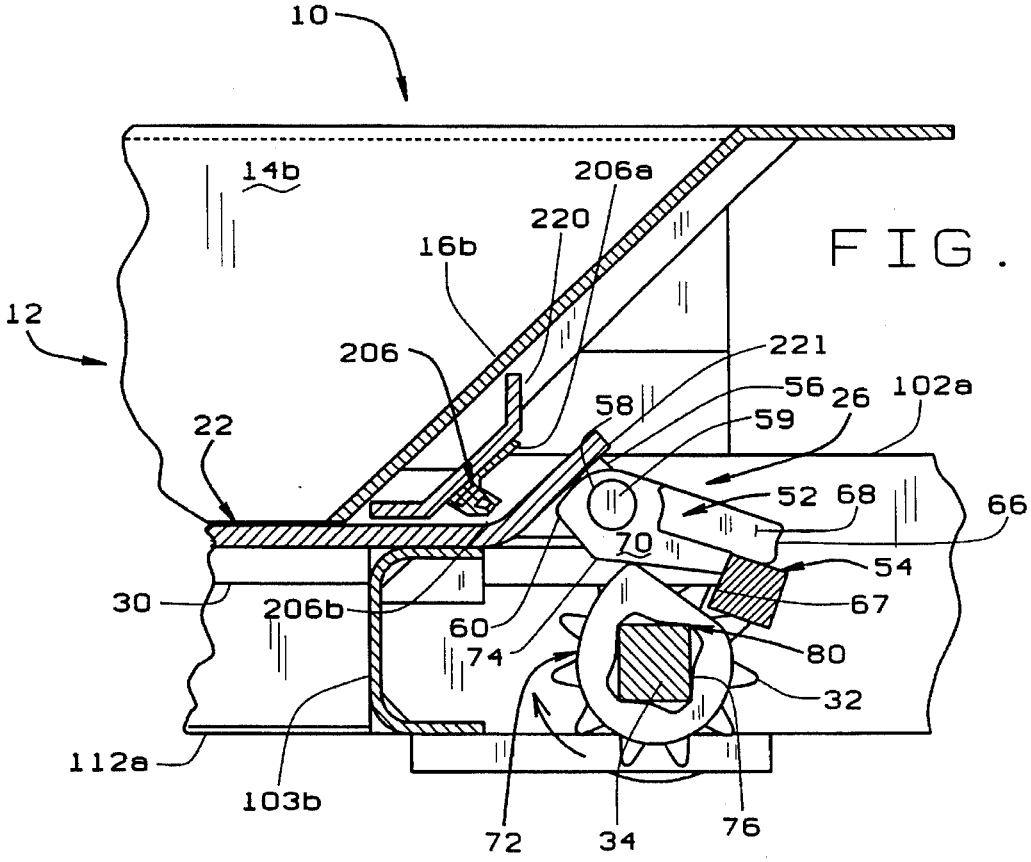
Figure 10A:
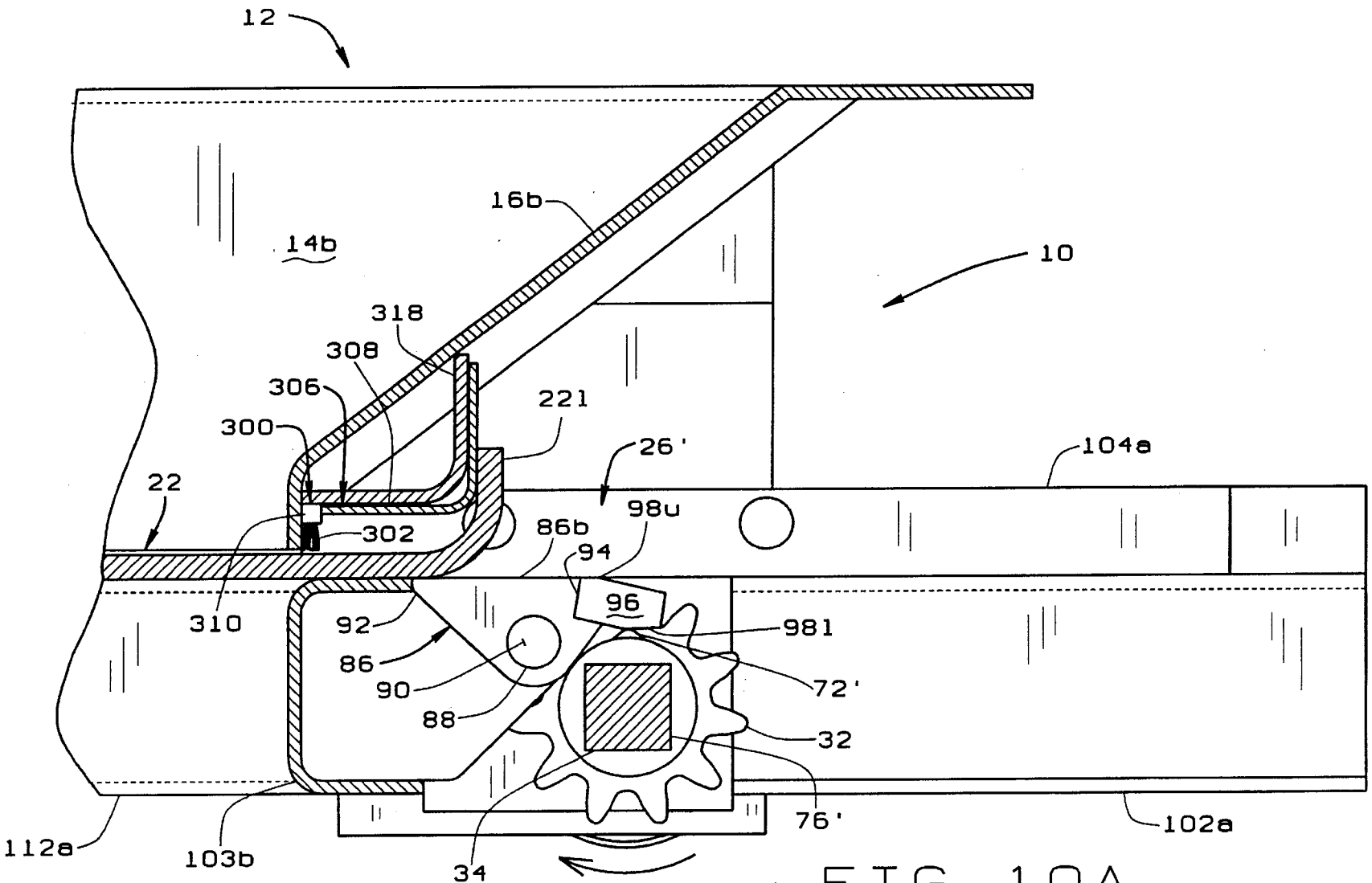
FIGS. 10A and 10B are partial sectional views similar to FIGS. 9A and 9B but illustrating a second arrangement of a latching mechanism operable by the gate opening mechanism.
Figure 10B:
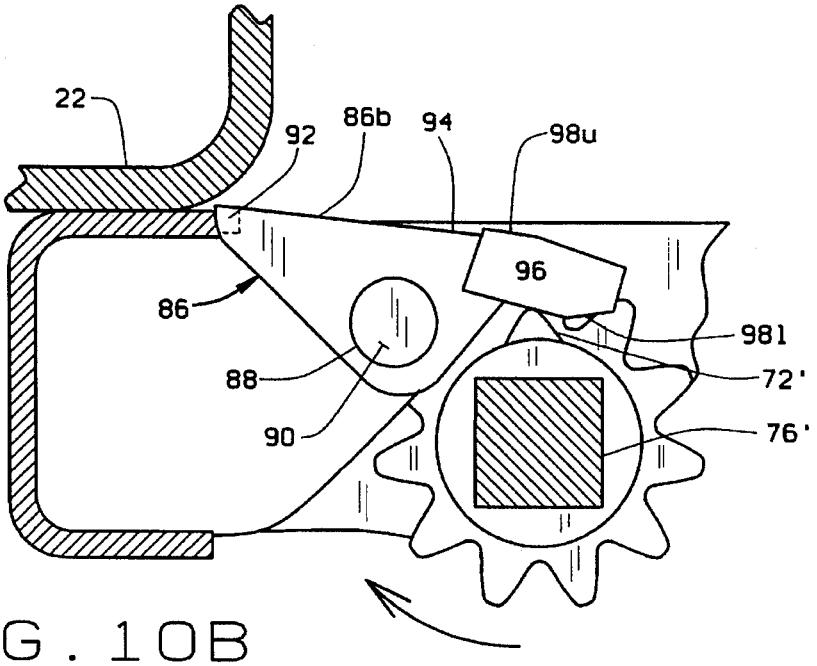
Figure 14:
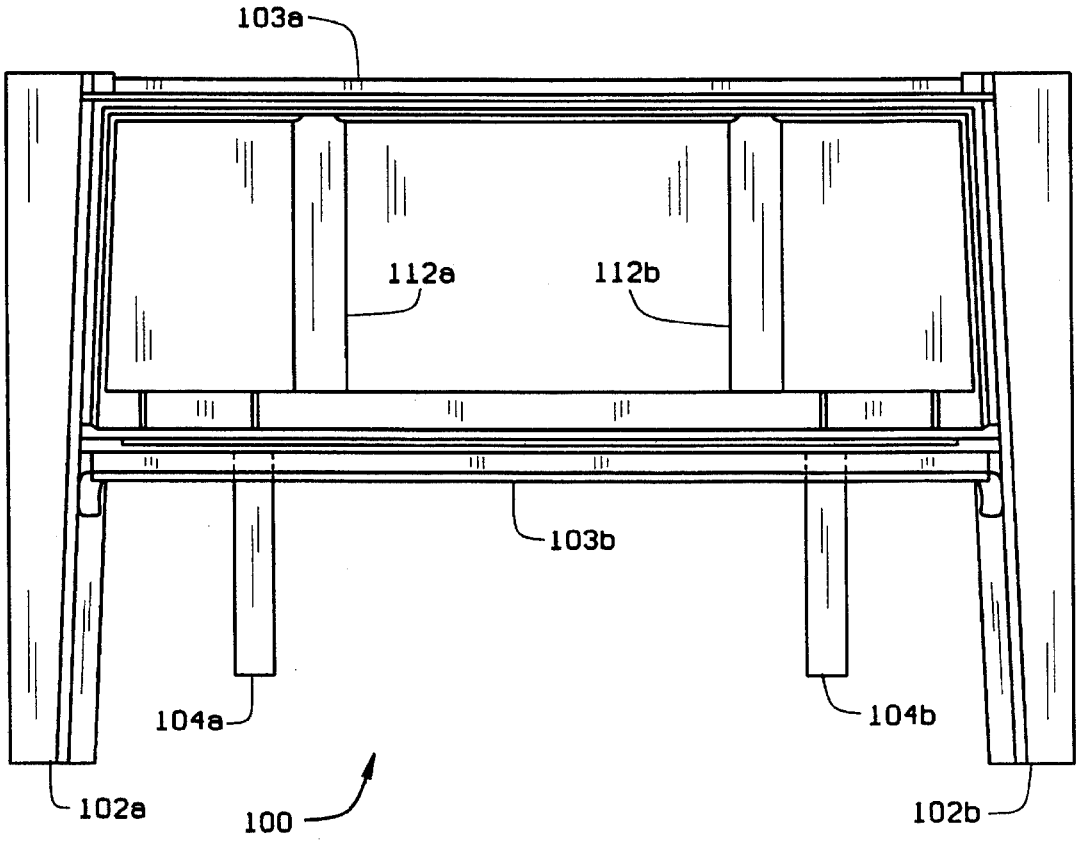
FIG. 14 is a plan view of the gate support structure of the gravity outlet.
Figure 15:
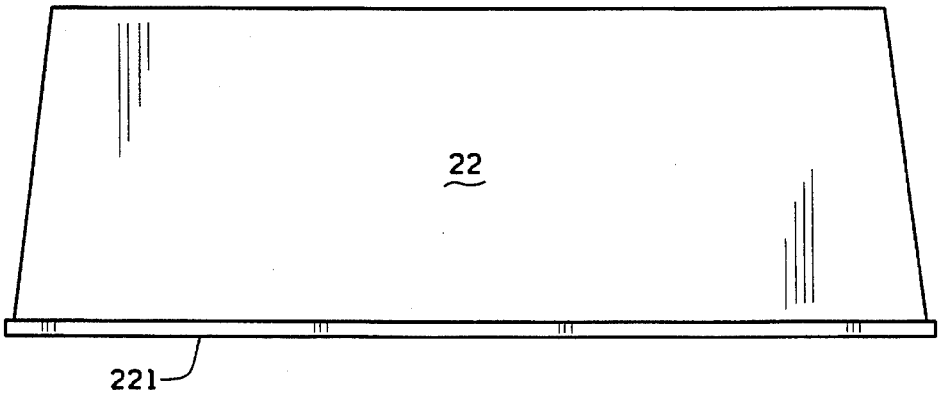
FIG. 15 is a plan view of the outlet gate.

Referring to FIG. 15, an outlet gate 22 is positioned beneath the outlet assembly. As best shown in FIG. 3, the discharge outlet D formed by the sidewalls and endwalls is generally rectangular. However, as shown in FIG. 15, gate 22 is trapezoidal when viewed in plan. The rearward end of the gate has an upwardly turned lip 22L. The height of this lip is greater than the height of the opening formed between the lower end of the sidewalls and endwalls and the support structure members. Also, as seen in FIG. 14, in addition to gate supports 104*a*, 104*b*, support structure 100 also includes spaced supports 112*a*, 112*b* which extend longitudinally of the outlet between support elements 103*a*, 103*b*. These support elements comprise inverted U-shaped supports. Such supports are not present on current outlet designs. Because the upper end of these supports are rounded, grain falling on the top of these supports, as lading is discharged, readily falls off the supports and is not retained in the outlet. As is described hereinafter, the particular shape of gate 22 helps effect a tighter seal to prevent dirt, dust, debris, moisture, etc., from entering into the outlet assembly. Gate 22 is readily movable from a closed position to a fully open position when lading is to be discharged from the opening. A latch assembly 26 as shown in FIGS. 9A, 9B, or 26' as shown in FIGS. 10A and 10B, latches or locks the gate in its closed position. A gate operating mechanism 28 is used to move gate 22 back and forth between its respective open and closed positions. In accordance with the invention, the gate operating mechanism 28 automatically unlatches the latch assembly 26 or 26' when the gate operating mechanism is moving the gate from its closed to its open position. Further, gate operating mechanism 28 unlatches latch assembly 26 or 26' prior to moving the gate from its closed to an open position, and automatically relatches the latch assembly when the gate is moved from its open to its closed position. It is a feature of the invention that the lower edges of the sheets define a minimum discharge area. This means the lading footprint on the gate is a minimum. This reduces the torque required by the gate operating mechanism to open the gate.

Gate operating mechanism 28 first includes a rack 30 (see FIGS. 4, 5, 22A, and 22B) and a pinion gear or pinion 32 for moving the rack in the appropriate direction. The pinion gear is mounted on an operating shaft 34 which extends transversely of the gate from one side of the railcar to the other. As shown in FIG. 4, gate 22 can be opened and closed from either side of the railcar. For this purpose, a capstan 36*a*, 36*b* is fitted onto the respective end of the operating shaft. Operating shaft 34 is shown in FIG. 4 to extend through support members 102*a*, 102*b*, 104*a*, 104*b*, and 106*a*, 106*b*. The shaft is supported at its middle by a support collar 38. As shown in FIG. 3, collar 38 is connected to the outer face of support member 103*b* by a bracket 38*a*. Further, there is a rack 30 and pinion 32 arrangement located on both sides of the gate. In each instance, the rack is attached to the underside of the gate and the pinion is mounted on the operating shaft. The capstans 36*a*, 36*b* each have a head 40 in which are formed end and side openings 42 for a tool to be fitted into the head to rotate the operating shaft. Each capstan further has an inwardly extending sleeve 44 which is sized to fit over the respective outer end of the operating shaft. These sleeves extend inwardly to the respective support members 106*a*, 106*b*. As shown in FIGS. 9A, 9B, and 10, operating shaft 34 is rectangular (square) in cross-section and the sleeves 44 are correspondinly square in cross-section to matingly fit over the outer ends of the shaft. Referring to FIGS. 3 and 4, opposed slots 46 are formed in the sleeves 44 adjacent the inner end of the sleeves. A transversely extending bore 48 extends through each end of the operating shaft. When the capstans are fitted onto the ends of the operating shaft, a pin 50, bolt, or other attachment device is fitted through the slots and the bore to secure the capstan to the shaft. Now, when a tool (not shown) is inserted into one of the openings 40 in the head of the capstan, rotation of the capstan causes rotation of the operating shaft.

Figure 24A:
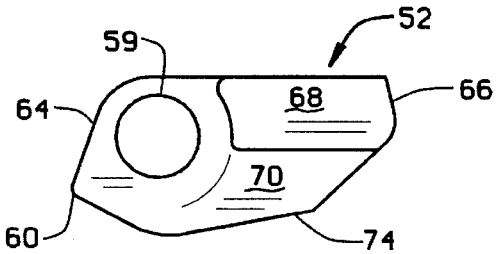
FIGS. 24A–24C are respective side elevational (FIG. 24A), top plan (FIG. 24B), and perspective (FIG. 24C) views of a latch used to latch the gate in a closed, locked position; and, FIGS. 25A and 25B are respective elevational (FIG. 25A) and perspective (FIG. 25B) views of the alternate latch embodiment.
Figure 24B:
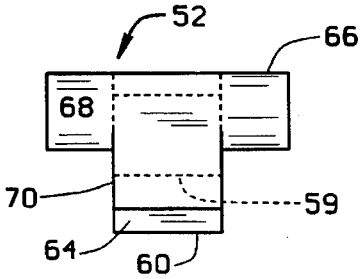
Figure 24C:
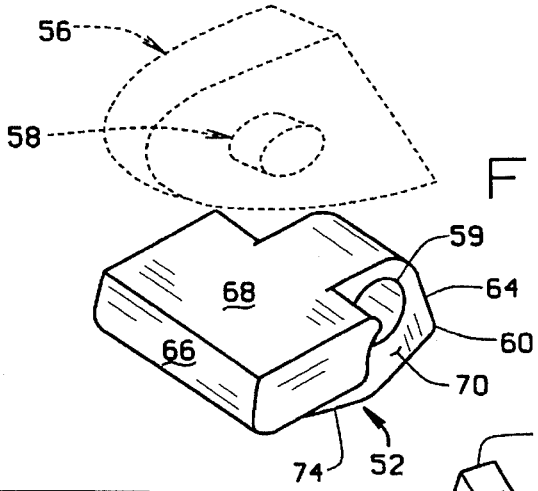
Figure 25A:
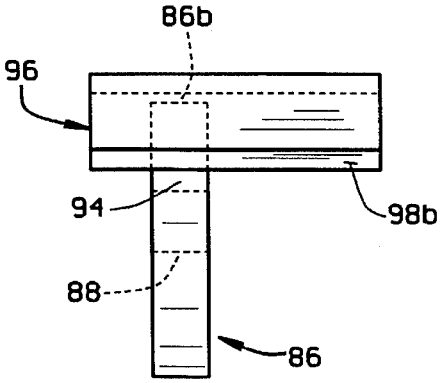
Figure 25B:
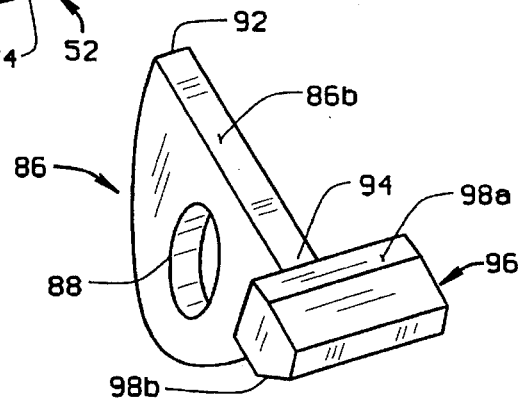

Referring to FIGS. 9A and 9B the latch assembly 26 is shown to include a latch member 52 and a blocking bar 54 which is generally rectangular in cross-section. A bracket 56 is attached to the outer face of the raised lip portion 22L of gate 22. Each bracket includes a pivot pin 58 upon which latch member 52 is pivotally mounted (see FIG. 24C). The latch member has a transverse bore 59 sized for the latch member to fit on pin 58, and a rearward extension or tail 60 which bears against the outer gate surface when the gate is in its closed, locked position of FIG. 9A. As seen therein, in this position the latch member is inclined with respect to the horizontal. Referring to FIG. 24A, tail 62 is shown to be formed by a rear face 64 of the latch member which is inclined 20°, for example, from the vertical.

Pinions 32 are installed on operating shaft 34 so to respectively be adjacent to, and inwardly of, the support members 102*a*, 102*b*. Each blocking bar 54 is mounted on an inner face of the respective support members 102*a*, 102*b* and is inclined with respect to the horizontal at about the same angle as the latch member when in its FIG. 9A position. The length of the blocking bars is such that when the gate is in its closed, locked position, the outer face 66 of the latch member bears against a face 67 of the respective blocking bar. Latch face 66 comprises the forward end of a horizontal, outward extension 68 of the latch member; this extension being at the forward, upper end of a main body 70 of the latch member. Extension 68 extends equidistantly on both sides of the main body. This allows the latch member to be interchangeably installed on either side of the gravity outlet.

A lifting cam 72 is mounted on operating shaft 34 so to be positioned beneath a bottom surface 74 of the latch member. Cam 72 has a generally square transverse bore 76 sized for the cam to be mounted on the operating shaft. To open gate 22, operating shaft 34 is rotated clockwise as indicated by the arrow in FIG. 9A. This movement of the shaft rotates cam 72 so the cam surface contacts the underside of the latch member and lifts it away from contact with the blocking bar. Were the operating shaft simultaneously causing lifting of the cam and movement of pinion 32 to open the gate, the gate would be jammed in its closed position. At the same time, however, it is desirable that unlatching the latch member to unlock the gate not require separate operations by the operator trying to open the outlet.

Figure 11:
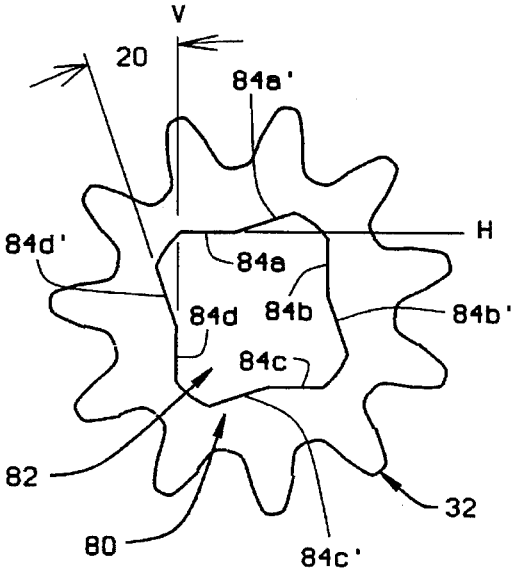
FIG. 11 is an elevational view of a pinion forming a portion of the gate operating mechanism.
Figure 12:
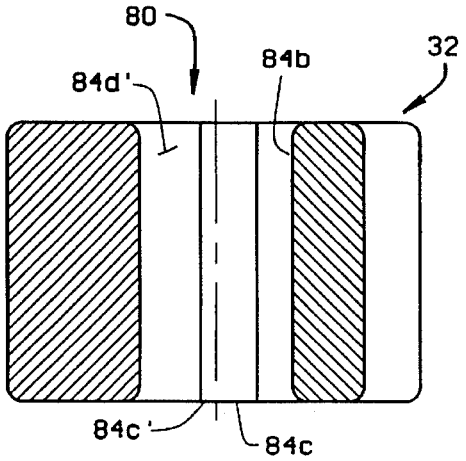
FIG. 12 is a sectional view of the pinion taken along line 12—12 in FIG. 11.
Figure 13:
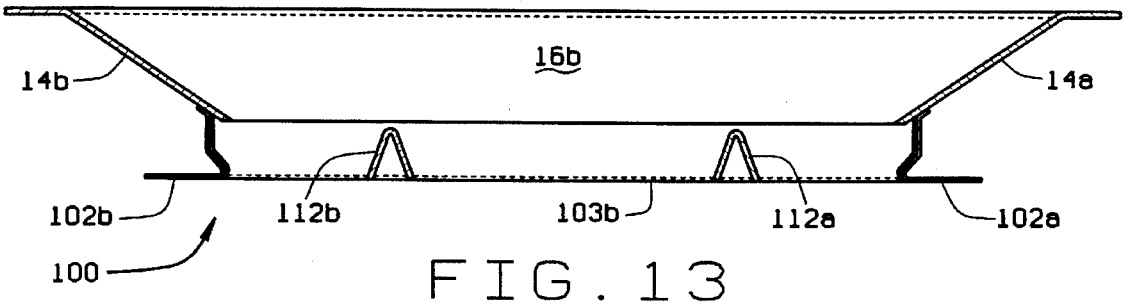
FIG. 13 is a sectional view of the gravity outlet taken along line 13—13 in FIG. 3.

To overcome this problem, the operating mechanism includes lost motion means indicated generally 80. Referring to FIGS. 11 and 12, pinion 32 is shown to have a bore 82 for mounting the pinion on operating shaft 34. While the bore is generally square with the sides of the bore dimensioned so the pinion is received on the shaft, each face 84 of the bore is angled outwardly with respect to a respective vertical or horizontal reference line V or H. In each instance, the face is angled, for example, 20° with respect to the reference line. The angle is formed from the center of each face toward one endthereof. Thus, each face of the bore has a vertical or horizontal segment 84*a*, 84*b*, 84*c*, or 84*d*, and an outwardly angled segment 84*a*', 84*b*', 84*c*', or 84*d*'. It will be noted that the 20° angle corresponds with that of latch surface 64 to the vertical.

The operation of lost motion means 80 is such that for the first 20° of operating shaft rotation, the sides of the shaft do not contact the bearing portion of each pinion bore face so to impart a rotary force to the pinion. Rather, during this interval, the operating shaft is rotating cam 72 against the underside of latch member 52 to lift the latch from its FIG. 9A to its FIG. 9B position; that is, its lifts the latch member clear of the blocking bar. After 20° of rotation, the operating shaft engages and turns the pinion gear to move gate 22 in its opening direction. When the gate is closed, the reverse happens. For all but the last 20° of shaft rotation, the operating shaft is turning the pinion to draw the gate closed. Since the latch member is attached to the gate, as the gate closes, it draws the latch member over the blocking bar. When the gate clears the blocking bar, it falls, by gravity, back into its FIG. 9A gate latching position, locking the gate closed. It will be understood that rotation of the operating shaft to effect gate closure rotates cam 72 back to its initial position. As a result of the above gate operating, latch member construction, gate 22 is automatically unlocked prior to being opened, and automatically relocked after being closed. This provides not only for simplified outlet operation, but also insures that gate is not inadvertently opened which could result in contaminated lading.

Referring now to FIGS. 10A and 10B, 25A and 25B, latch assembly 26' is shown to include a latch member 86, unlike latch member 52, is not mounted to gate 22; but rather, is pivotally mounted on a side support member 102. As with latch assembly 26, assembly 26' includes two latch members 86 one of which is pivotally mounted on support member 102A, and the other on support member 102B. In FIG. 10B, latch member 86 is shown to have an inverted triangular shape. An opening 88 is formed at the apex of the triangle for installing the latch member on a pin 90 on the support member. A contact end 92 of the latch member is generally rounded, and extends above the lower end of the gate, as shown in FIG. 10B to lock the gate in its closed position. The opposite end 94 of the latch member is truncated in an L-shaped fashion. An elongate bar 96, which is generally rectangular in cross-section, fits on this end of the latch member. The bar has an upper corner 98*u* (the upper left corner in FIGS. 10A, 10B) which is shaved or flattened so to to create a uniform surface with the base 86*b* of the triangular shaped latch member. This allows the gate to move over the top of the latch member when the member is moved to its FIG. 10A position for gate opening movement. Bar 96 also has a lower corner 981 (the lower right corner in FIGS. 10A, 10B) which is also flattened in aspect.

A lifting cam 72' is mounted on operating shaft 34 so to be positioned beneath bar 96 of latch member 86. Cam 72' is similar in construction to cam 72 having a generally square transverse bore 76' sized for the cam to be mounted on the operating shaft. However, as shown in FIGS. 10A and 10B, bore 76' does not have the angled face segments which cam 72 has. However. like latch assembly 26, latch assembly 26' is operated so that initial movement of the operating shaft effects release of the latch member to unlock gate 22. As shown in FIG. 10B, when gate 22 is closed and locked, the contact surface of cam 72' bears against the underside bar 96. When operating shaft 34 is rotated clockwise as indicated by the arrow in FIG. 10B, movement of the shaft rotates cam 72' so the cam surface lifts end 94 of the latch member and rotates the latch member counterclockwise. This movement lowers the blocking end 92 of the latch member. After approximately 20° of cam rotating, the latch member is moved to its unblocking position. At this time, the cam surface is in contact with face 981 of the bar. Because of its flattened contour, movement of the cam surface over this face does not produce further movement of the latch member. Continued rotation of the operating shaft does effect opening movement of gate 22, the bottom surface of the gate sliding over base 86*b* of the latch member and the flattened surface 98*u* of the bar. Again, unlocking and opening movement of the gate does not require separate operations by the operator trying to open the outlet.

To close the gate the above described process is reversed. As the gate reaches its closed position, the cam surface of cam 72' moves off of surface 98*u* of bar 98 and over the underside of the bar. Latch member 86 now pivots clockwise about pivot pin 90 until end 92 of the latch member extends above the lower level of gate 22. This is the blocking position of the latch member and locks the gate in its closed position. Again, this locking movement takes place over the last 20° of shaft 34 rotation.

Regardless of the latch assembly with which gate 22 is equipped, it is important that a seal be effected between the gate and the respective sides of the outlet. This is to insure that dirt, dust, moisture, etc., do not migrate into outlet 10 and contaminate the lading. It is further important that as gate 22 is opened and closed, that particles of lading not be carried outside of the outlet opening by the gate. This is important because lading which may be carried outside the opening by movement of the gate, may subsequently be carried by inside the outlet by the gate at a later time. The lading could then contaminate the lading carried in the railcar at this later time.

Figure 16:
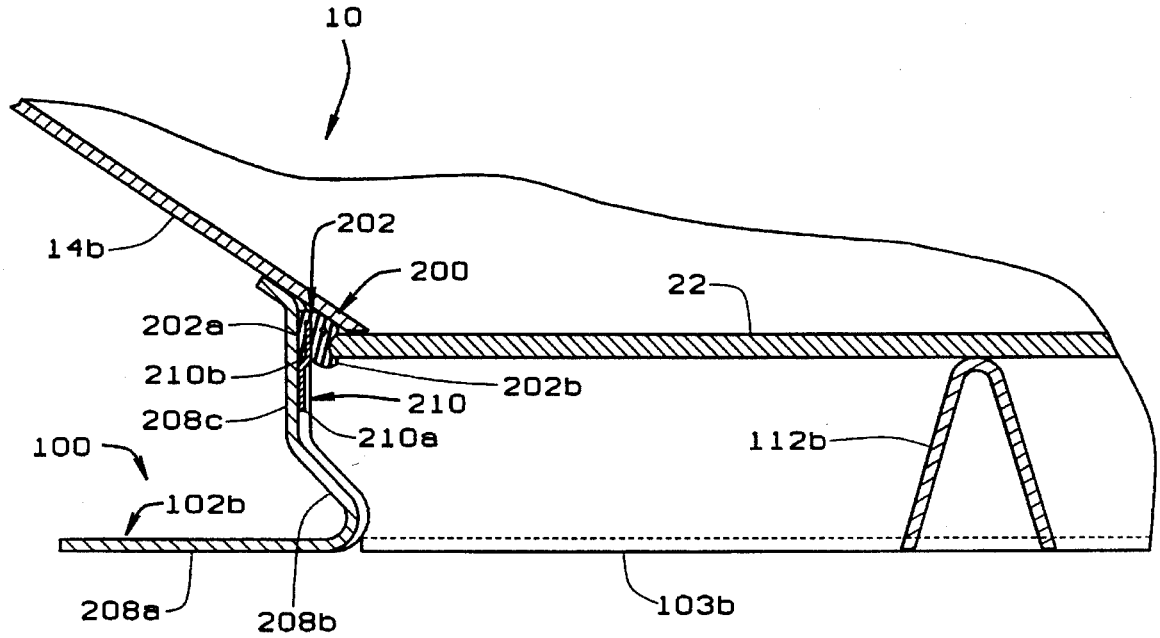
FIG. 16 is a partial sectional view of the outlet illustrating a gate seal extending along the sides of the outlet and compressed by the gate when in its closed position.

Referring to FIGS. 9A, 9B, 16 and 17, a first sealing means 200 includes a sealing element 202 which extends along each side of the outlet (only one side is shown in FIG. 16), a sealing element 204 which extends across the front end of the outlet, and a sealing element 206 which is installed on the opposite end of the outlet and is contacted by the angled portion 22L of gate 22. As shown in FIG. 16, side support member 102*b* has an outwardly turned flange section 208*a*, a curved section 208*b* which is of a generally reverse C-shape, and a vertical section 208*c* the upper end of which flares outwardly and abuts against the outer wall of sidewall 14*b* of the outlet. A mounting plate 210 is installed on the inside face of section 208*c* of support member 102*b*. Plate 210 has a lower section 210*a* which fits against the inside face of section 208*c*, and an upper section 210*b* which is spaced inwardly from the face. Sealing element 202 is, for example, a rubber compression seal having a 0.25 compression factor. The sealing element has an inverted U-shape with one leg 202*a* of the element fitting in the space between plate section 210*b* and the inner face of support member 102*b* section 208*c*. The other leg 202*b* of the sealing member extends down the other side of the plate section 210*b*. This leg 202*b* is generally R-shaped in cross-section. That is, it has a generally rounded upper section which projects inwardly toward the outlet opening, a concave center portion, and an inwardly projection lower portion. As shown in FIG. 16, the side of gate 22 is flat. The gate sealingly fits against the center portion of sealing member leg 202*b*. As previously discussed, the support structure of the outlet is generally trapezoidal in plan, with the forward end of the structure being slightly narrower than the rearward end. The space between the sealing members 202 along each side of the gate is slightly narrower than the corresponding width of the gate at any point therealong. Accordingly, as the gate is closed, the sides of the gate compress their associated sealing members so a tight seal is formed along both sides of the gate when the outlet is closed.

Figure 17:
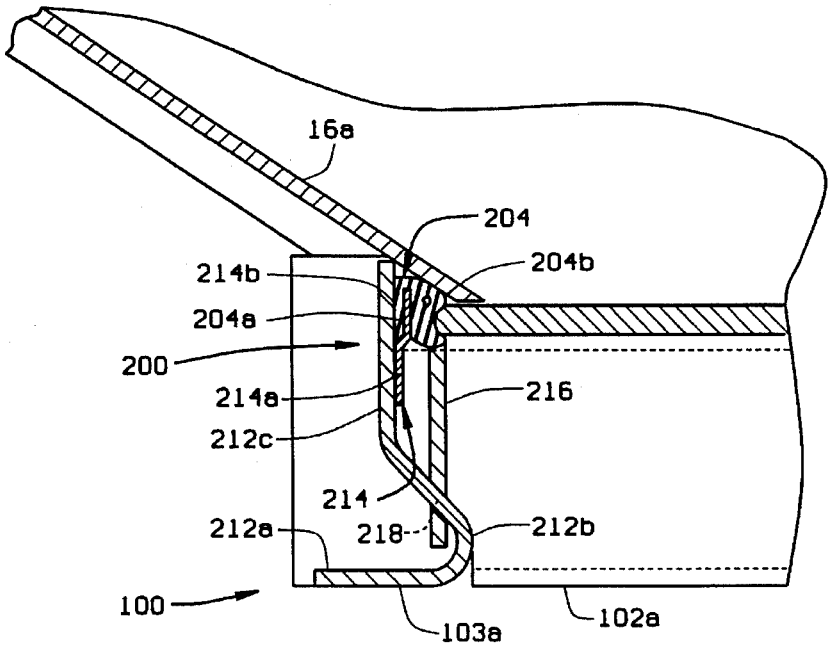
FIG. 17 is partial sectional view similar to FIG. 16 illustrating the gate seal portion extending across the end of the outlet opposite the end where the gate operating mechanism is installed, this portion of the gate seal also being compressed by the gate when in its closed position.

As shown in FIG. 17, end support member 103*b* is similar to the side support member and has a corresponding outwardly turned flange section 212*a*, a reverse C-shape section 212*b*, and a vertical section 212*c* whose upper end flares outwardly and abuts against the outer face of endwall 16*a* of the outlet. A mounting plate 214 is installed on the inside face of section 212*c*. A lower section 214*a* of the plate fits against the inside face of section 212*c*, with the upper section 214*b* being spaced inwardly from the face. Sealing element 204 is also of an inverted U-shape with one leg 204*a* of the element fitting in the space between plate section 214*b* and the inner face of support member 103*b* section 212*c*. The other leg 204*b* of the sealing member extends down the other side of the plate section 214*b*. As before, this leg is generally R-shaped in cross-section. The forward end of gate 22 is rounded and sealingly fits against the concave center portion of sealing member leg 204*b*. As gate 22 is closed and locked in place as previously described, this end of the gate is pressed into the sealing member so a tight seal is formed along this forward end of the gate.

Because gate 22 is heavy, there is a cantilevering action of the gate as it is closed. That is, the weight of the gate may it cause its forward end to incline at a slight downward angle to the horizontal when the gate is fully closed. This cantilevering could cause the seal between the sealing elements 202 and sealing element 204 and the gate to not be effected so a gap is formed between the gate and seal. As shown in FIG. 17, a vertical end support 216 (only one of which is shown) is installed at each end of support member 103*a* to support the cantilevered end of the gate at opposite corners of the gate. These supports are each elongate bars that are generally square in cross-section. An opening 218 is formed in support member 103*b* at each end of the member. The support is fitted through the opening until the upper end of the support is positioned beneath the lower, forward end of the gate so as to exert a slight upward force on the gate. The support is then welded to support member 103*b* to hold it in position. As a result, when the gate is closed, the forward end of the gate will ride over and be supported by the supports to maintain the gate in a horizontal sealing position.

Because the opposite end of gate 22 has the angled lip 22L, sealing element 206 is of a different construction than the other sealing elements. First, a bracket 220 which is of a general U-shape but with the legs of the bracket flared outwardly, is attached to the outer face of outlet endwall 16*b*. When installed, the base of the bracket rests at the same angle as the lip portion of the gate. Sealing element 206 is attached to the outer surface of the bracket base. The sealing element has a mounting strip portion 206*a* which extends the length of the bracket. The sealing element further has a box-shaped sealing section 206*b* which comprises a generally rectangular, hollow sealing element. The sealing element is positioned on bracket 220 so sealing section 208*b* contacts the gate at the junction between the lip portion of the gate and the flat main gate portion thereof. Because of this, the lower wall of the sealing section is angled with respect to the outer wall thereof so the angle formed therebetween approximates that between the lip portion and main body of gate 22. Accordingly, when the gate is closed, as shown in FIG. 9A, the lip portion of the gate is drawn toward bracket 220 and compresses the sealing element. Since the seal is formed at the juncture between the lip and main body portions of the gate, the seal is effected at the point where contaminants might otherwise migrate into the outlet at the opening between the outlet and the gate.

Figure 18:
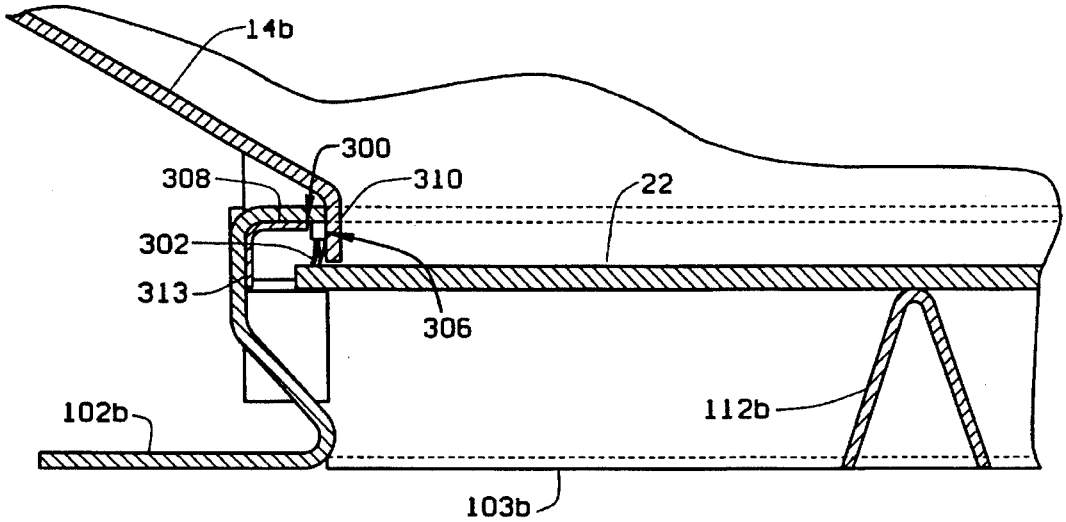
FIG. 18 is a partial sectional view similar to FIG. 16 but illustrating a brush seal used to prevent lading from being carried by the gate as it is moved from one position to another.
Figure 19:
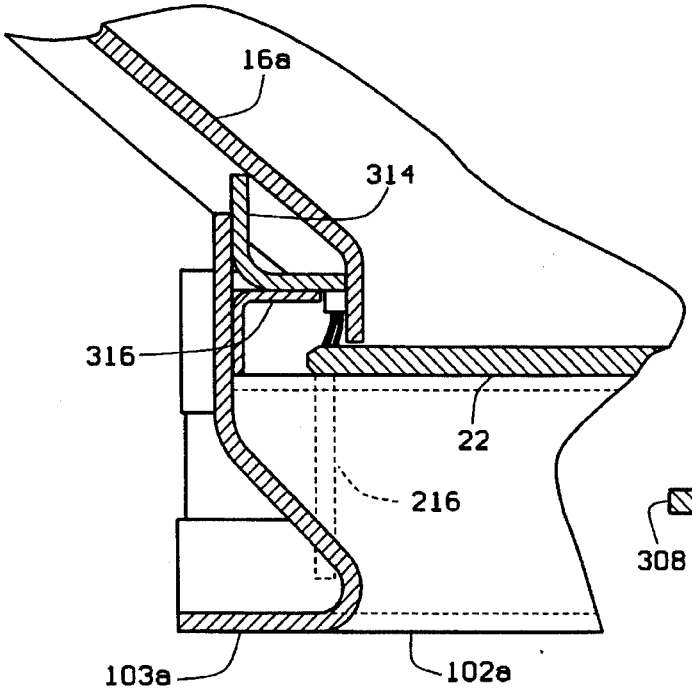
FIG. 19 is a partial sectional view similar to FIG. 17 and illustrating another section of the brush seal.
Figure 20:
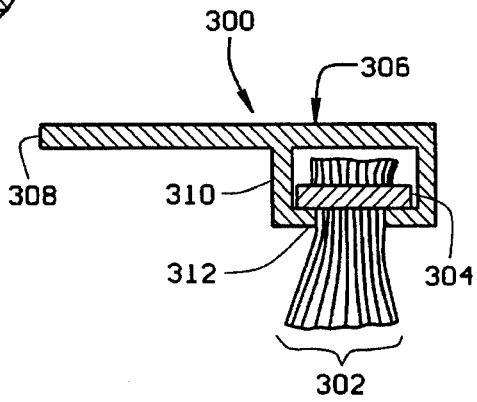
FIG. 20 is an end elevational view of a brush seal.

Finally, referring to FIGS. 6, 7, 10A, and 18–21C, a brush seal means 300 performs the previously mentioned function of sweeping or brushing particles of lading off the gate and into the outlet opening, as the gate is moved, to prevent particles of the lading from being retained in the outlet after a lading discharge operation. The brush seal is installed on the outside of the outlet and the brush seal elements extend about the periphery of the outlet opening D. As shown in FIG. 20, brush seal means 300 includes a plurality of bristles 302 which a bound together or captured in a clip 304. The clip is an elongate clip which is insertable in a holder 306. The holder has an attachment skirt 308 and an open, slotted housing 310 in which clip 304 is inserted through a slot 312. The bristles are nylon bristles whose stiffness is a function of both the metal from which they are formed, and the length of the bristle which extends from the clip. As a rule, the shorter this length, the stiffer the bristle. The holder is installed so slot 312 is on the underside of receptacle 310. The width of the receptacle is slightly greater than the width of holder 304 to facilitate insertion and removal of the brush/clip assembly. The width of the slot is slightly greater than the width of the bristles in the holder, but less than the width of the holder for the brush/clip assembly to remain in the receptacle.

Figure 21A:
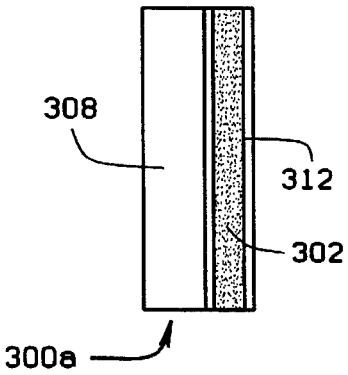
FIGS. 21A–21C are bottom plan views of various brush seal configurations usable with the outlet.
Figure 21B:
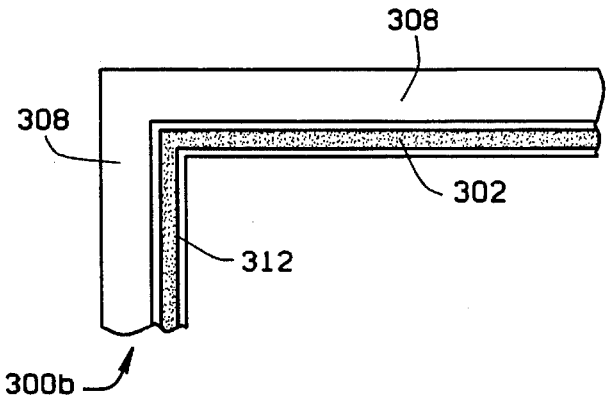
Figure 21C:
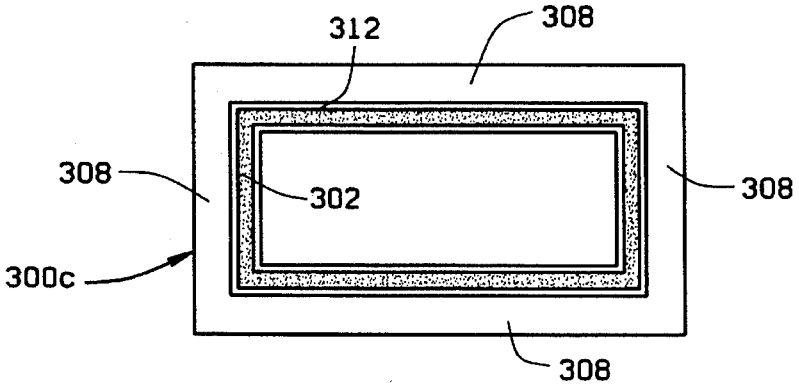
Figure 22A:
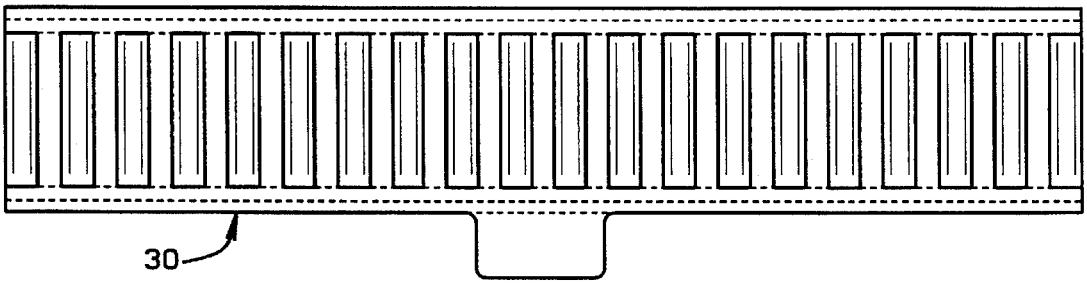
FIGS. 22A and 22B are respective plan and elevational views of a rack installed on the bottom of the gate for moving the gate.
Figure 22B:
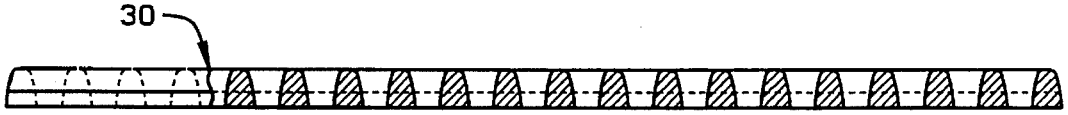
Figure 23A:
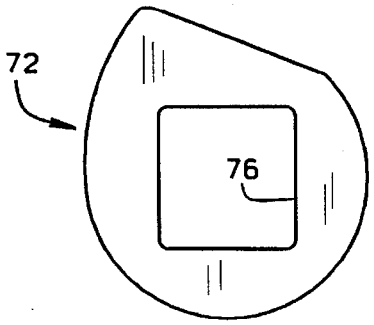
FIGS. 23A and 23B are respective side and end elevational views of a cam used used to latch and unlatch the gate.
Figure 23B:
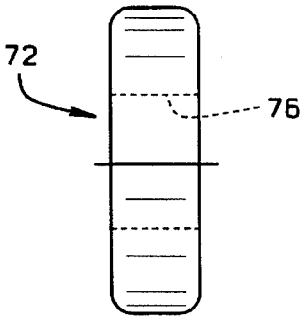

As shown in FIGS. 21A–21C, brush seal means can come in a variety of configurations. In FIG. 21A, a brush seal means 300*a* is installable along one side or one end of the outlet. In FIG. 21B, a brush seal means 300*b* is installable over one-half the perimeter of the outlet; i.e., it is installed along one side and one end of the outlet. In FIG. 21C, brush seal means 300c is installed as a single piece and surrounds the entire perimeter of the outlet.

Installation of the brush seal means, however configured, is to permanently install holder 306 as is described hereinafter. Thereafter, as the bristles along one side of the outlet become worn, the bristle/clip assembly is removed by sliding the assembly out of receptacle 310 and sliding a new assembly in its place. Referring to FIG. 18, along the sides of the outlet, the upper end of the sidesupport member 102*a* or 102*b* is turned inwardly toward the outer face of its associated sidewall 14*a*, 14*b*. As shown in FIG. 18, this inwardly turned portion of the member contacts the sidewall. An L-shaped bracket 313 is secured to the inner face of the support member so one leg of the bracket abuts the vertical portion of the support member, and the other bracket leg extends beneath the inwardly turned portion of the support member. The length of this second leg is less than the length of the inwardly turned portion of the support member. The skirt 308 of housing 306 is captured between the bracket and support member to install the brush seal means in place. Further, the housing is so supported above gate 22 that the bristles 302 of the brush seal means sweep along the gate as the gate is opened and closed.

As shown in FIG. 19, installation of the brush seal means along the front of the outlet involves use of two brackets. A first L-shaped bracket 314 has its legs attached to the outer surface of the endwall of the outlet. The height and width of the bracket are such that the vertical leg of the bracket bears against the vertically extending portion of support member 103*a*. A second and smaller L-shaped bracket 316 is installed beneath bracket 314. One leg of this second bracket also abuts the vertical portion of the support member. The other leg of this second bracket extends inwardly and abuts the inwardly extending leg of bracket 314. This time, skirt 308 of housing 306 is captured between the inwardly turned legs of the brackets to install the brush seal means in place. Again, the housing is so supported above gate 22 that the bristles 302 of the brush seal means sweep over the forward end of the gate to keep particles of lading within the outlet as the gate opens and closes.

Figure 6:
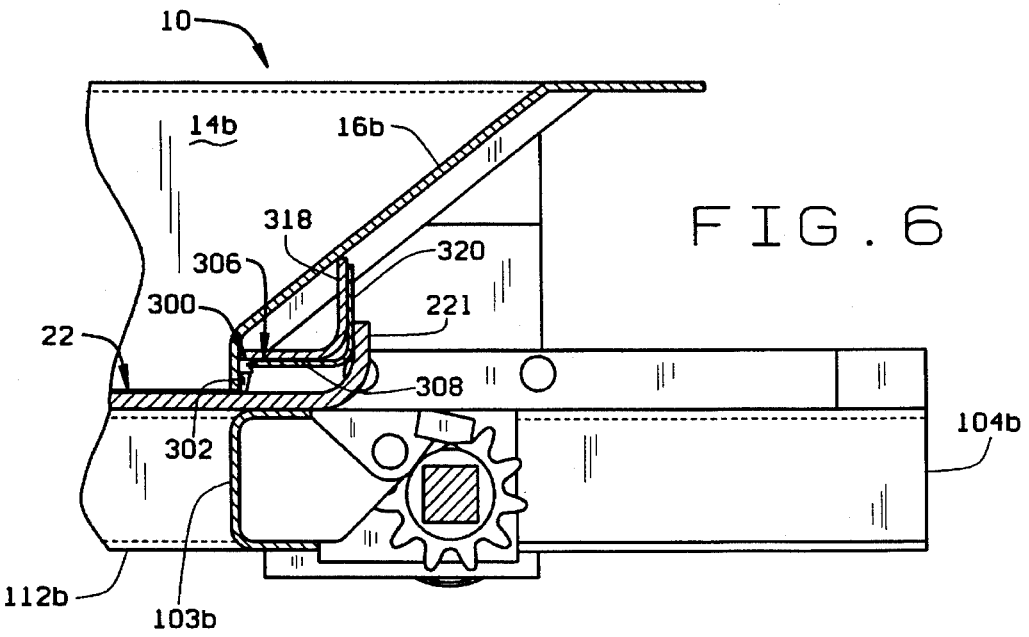
FIG. 6 is a sectional view taken along line 6—6 in FIG. 4.
Figure 7:
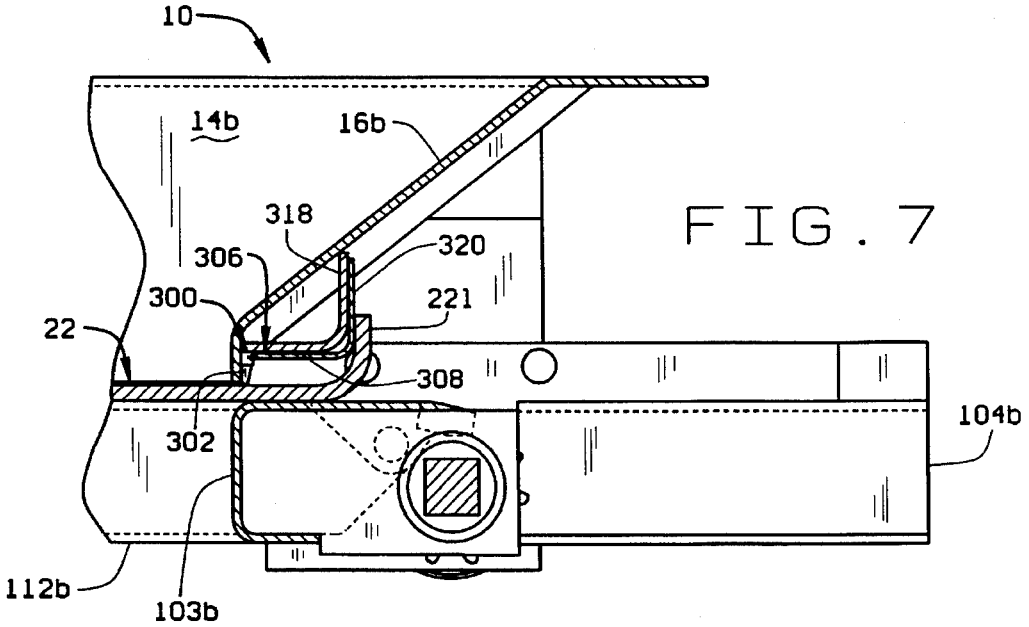
FIG. 7 is a sectional view taken along line 7—7 in FIG. 4.
Figure 8:
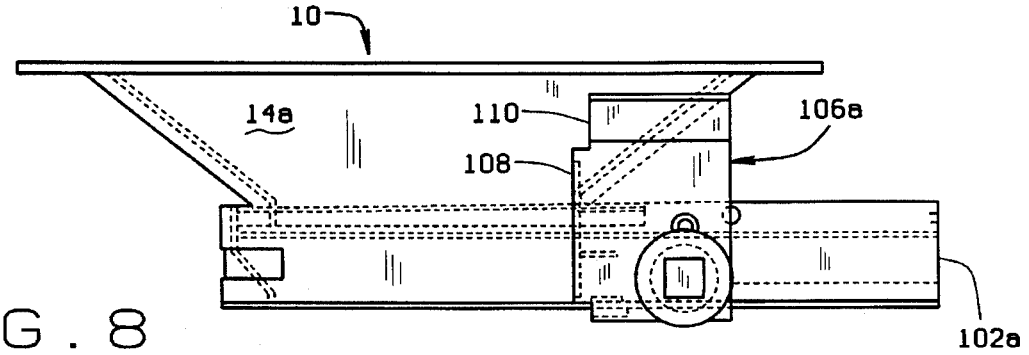
FIG. 8 is a side elevational view of the outlet.

In FIGS. 6, 7, and 10A, installation of the brush seal means along the rear of the outlet also involves use of two brackets. A first L-shaped bracket 318 has its legs attached to the outer surface of endwall 16*b* of the outlet. A second and smaller L-shaped bracket 320 is installed to the outside of bracket 318 with the legs of bracket 320 abutting the legs of bracket 318. Now, skirt 308 of housing 306 is captured between the inwardly turned legs of the respective brackets to install the brush seal means in place. As before, the housing is so supported above gate 22 that the bristles 302 of the brush seal means sweep over the portion of the gate being withdrawn from the outlet to keep particles of lading within the outlet as the gate opens and closes.

With respect to each of the three above described installations, it is not necessary that the respective brackets extend the length of the sidewall or endwall of the outlet. Rather, there may be a plurality of spaced brackets along the respective sidewalls or endwalls with the number of brackets being sufficient to maintain the brush seal means in contact with gate to produce the desired sealing.

What has been described is a gravity outlet for use on covered hopper railway cars. The outlet has a gate movable relative to the outlet to open and close the outlet. A gate operating mechanism is used for moving the gate, and a latch mechanism is used to lock the gate in its closed position. This arrangement operates such that the operation of the gate operating mechanism and latching mechanism are integrated. Accordingly, movement of the gate operating mechanism automatically unlatches the gate when the mechanism is operated toopen the gate, and automatically latches the gate in a locked position when the mechanism is operated to close the gate. A lost motion arrangement is employed by which unlocking and opening of the gate and closing and relocking of the gate are accomplished in a proper sequence utilizing but a single, simple mechanism. Further, the outlet has a discharge area which is open throughout and has no shelfs, ledges, pockets, etc., where lading could collect so as to contaminate a subsequent lading. The outlet employs a sealing arrangement which prevents dirt, dust, debris, rain, etc. from getting into the outlet and contaminating a lading. Also, the torque required to effect opening of the gate is generally constant for various loading conditions. Overall design of the outlet is such that the outlet meets AAR standards concerning gravity outlet designs. Finally, the outlet is readily cleaned after usage, and can be used both as original equipment on a railcar or as a retrofit outlet.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. A gravity outlet for discharging lading from a railway car comprising:

means defining an outlet assembly attached to a discharge opening in the railcar, the assembly means including an upper end attached to the discharge opening and sidewalls and endwalls sloping downwardly and inwardly from the upper end with a bottom portion of the sidewalls and endwalls defining a discharge outlet through which lading flows, by gravity, when it is discharged from the railcar;

an outlet gate positioned beneath the outlet assembly and movable relative to the discharge outlet between respective open and closed positions to open and close the outlet;

latch means for latching the outlet gate in its closed position when the gate is closed to prevent inadvertent opening of the gate and spillage of lading, the latch means including a latch for the gate and a lock contacted by the latch to block movement of the gate when the gate is in its closed position;

gate operating means for moving the gate between its open and closed positions, the gate operating means automatically unlatching the latch means when the gate operating means is moving the gate from its closed to its open position, the gate operating means unlatching the latching means prior to moving the gate, and the gate operating means automatically relatching the latch means when it moves the gate from its open to its closed position, the gate operating means including a rack attached to one surface of the gate and a pinion engaged with the rack for moving the gate when the pinion is rotated, the pinion being mounted on an operating shaft rotatable in one direction to effect opening of the shaft and in the opposite direction to effect gate closing, the gate operating means further including means for moving the latch out of contact with the lock to free the gate for movement, the means for moving the latch out of contact with the lock including a cam mounted on the operating shaft and movable thereby, and, lost motion means by which movement of the operating shaft in the direction to effect opening of the gate first causes the cam to move the latch out of contact with the gate and then subsequently causes rotation of the pinion to move the rack, the lost motion means being formed on the pinion, and means for pivotally mounting to the latch directly on the gate and the lock comprising a blocking bar against which one face of the latch abuts when the gate is closed whereby inadvertent movement of the gate is blocked by the contact of the one face of the latch with the blocking bar.

2. The gravity outlet of claim 1 wherein the operating shaft is rectangular in cross-section and the pinion has a central opening therethrough sized to receive said operating shaft, rotation of the operating shaft in one direction to open the gate applying a force on one face of the pinion opening, and in the opposite direction to close the gate applying a force on an opposite face of the pinion opening.

3. The gravity outlet of claim 2 wherein each respective face of the pinion opening has a fixed offset angle whereby the operating shaft has to rotate through a predetermined angle prior to applying a gate opening or gate closing force on the respective face.

4. The gravity outlet of claim 1 wherein the cam bears against a second face of the latch for an inital movement of the operating shaft to open the gate to rotate the cam relative to the latch and causes a cam surface of the cam to lift the latch out of contact with the blocking bar, this initial movement of the operating shaft being a lost motion movement with respect to the pinion, movement of the pinion by the operating shaft occurring subsequent to the cam lifting the latch away from the blocking bar so the pinion can effect movement of the gate to its open position, opening movement of the gate effected by the pinion moving the latch away from the blocking bar.

5. The gravity outlet of claim 4 wherein movement of the operating shaft to rotate the pinion to effect closing movement of the gate causing the latch to be drawn over the blocking bar as the gate reaches its closed position with subsequent rotation of the operating shaft after the gate reaches its closed position being another lost motion movement with respect to the pinion, this lost motion movement of the operating shaft moving the portion of the cam surface which lifted the latch away from the latch, the latch thereby falling back into its initial position with the one surface of the latch abutting the blocking bar.

6. The gravity outlet of claim 1 wherein the outlet defined by the sidewalls and endwalls is trapezoidal when viewed in plan and the gate is correspondingly trapezoidally shaped.

7. The gravity outlet of claim 6 further including seal means extending circumferentially about the perimeter of the outlet, the sides and ends of the gate compressing against the seal means when the gate is closed to prevent solid and liquid material from entering the gate and contaminating the lading.

8. The gravity outlet of claim 7 further including support posts positioned at the end of the outlet opposite the gate operating means for supporting a distal end of the gate when it is in its closed position for the gate to sealingly bear against the portion of the seal means cotacted by the distal end of the gate.

9. The gravity outlet of claim 1 further including gate support means positioned beneath the outlet and extending transversely of the discharge outlet to the support the gate as it moves between its open and closed positions.

10. The gravity outlet of claim 9 wherein the gate support means includes a pair of spaced supports the upper portion of each of which is rounded for lading falling on the supports when the gate is open to flow off the supports and not be retained thereon.

* * * * *